US009972210B2

(12) United States Patent
Aunkofer et al.

(10) Patent No.: US 9,972,210 B2
(45) Date of Patent: May 15, 2018

(54) METHOD AND SYSTEM FOR ASCERTAINING A LOCAL INFORMATION ITEM FOR A VEHICLE

(75) Inventors: Markus Aunkofer, Abensberg (DE); Marc Menzel, Weimar (Lahn) (DE); Ulrich Stählin, Eschborn (DE)

(73) Assignee: Continental Automotive GmbH, Hannover (DE)

( * ) Notice: Subject to any disclaimer, the term of this patent is extended or adjusted under 35 U.S.C. 154(b) by 724 days.

(21) Appl. No.: 13/028,905

(22) Filed: Feb. 16, 2011

(65) Prior Publication Data

US 2011/0227759 A1 Sep. 22, 2011

(30) Foreign Application Priority Data

Feb. 17, 2010 (DE) ..... 10 2010 008 306

(51) Int. Cl.
*G08G 1/123* (2006.01)
*G08G 1/16* (2006.01)

(52) U.S. Cl.
CPC ..... *G08G 1/161* (2013.01)

(58) Field of Classification Search
CPC combination set(s) only.
See application file for complete search history.

(56) References Cited

U.S. PATENT DOCUMENTS 5,635,923 A 6/1997 Steele et al.
5,848,373 A * 12/1998 DeLorme ..... G01C 21/20 340/990
7,825,782 B2 11/2010 Hermann
2004/0104823 A1* 6/2004 Chainer et al. ..... 340/933
2004/0178897 A1* 9/2004 Fennel ..... B60C 23/061 340/442
2005/0040970 A1* 2/2005 Hutchins et al. ..... 340/907
2007/0037605 A1* 2/2007 Logan ..... 455/567
2007/0054685 A1* 3/2007 Kellum ..... G01S 13/931 455/517
2007/0063824 A1* 3/2007 Gaddy et al. ..... 340/426.21
2008/0106439 A1* 5/2008 Breslau ..... G08G 1/205 340/988
2008/0201022 A1* 8/2008 Fields ..... B60Q 1/50 701/1
2008/0312788 A1 12/2008 Aulakh et al.
2009/0256695 A1 10/2009 Bettecken et al.

FOREIGN PATENT DOCUMENTS

DE 694 28 087 T2 4/2002
DE 10 2005 017 419 A1 10/2006
DE 10 2008 018 014 A1 10/2009
GB 2 447 731 A 9/2008
WO WO 2009/074655 A1 6/2009

* cited by examiner

*Primary Examiner* — Joseph Feild
*Assistant Examiner* — Cal Eustaquio
(74) *Attorney, Agent, or Firm* — Cozen O'Connor

(57) ABSTRACT

A method and system for ascertaining at least one traffic-related local information item for a vehicle includes a reception device in a radio system to receive sent data from a radio system in at least one other vehicle in the vicinity of the one vehicle as defined by the reception range of the reception device. The reception device is configured for the vehicle-internal capture and evaluation of data for at least one operating variable from the one vehicle. The traffic-related local information item is ascertained from the received data from the other vehicle.

10 Claims, 1 Drawing Sheet

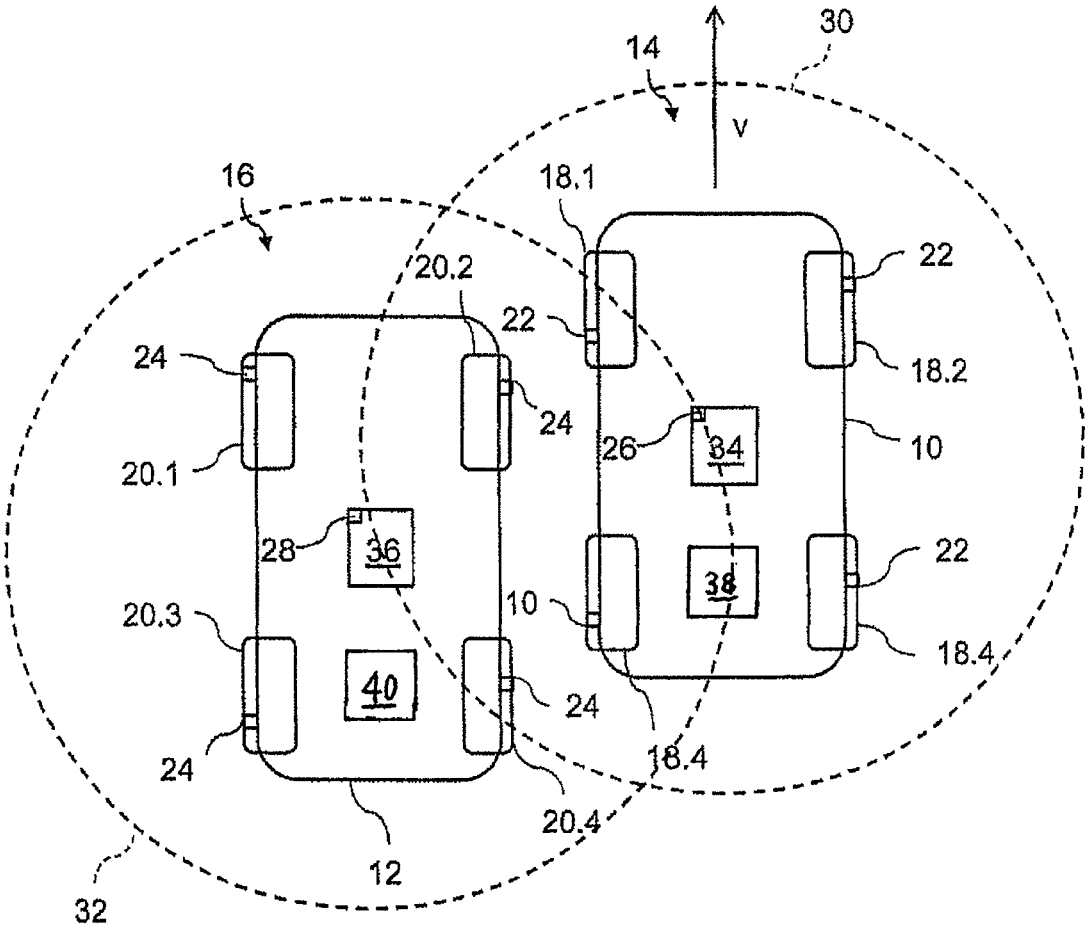
30
14
v
16
18.1
20.2
22
22
24
18.2
24
26
34
10
20.1
28
36
22
38
10
20.3
18.4
40
24
24
18.4
20.4
12
32

METHOD AND SYSTEM FOR ASCERTAINING A LOCAL INFORMATION ITEM FOR A VEHICLE

BACKGROUND OF THE INVENTION

1. Field of the Invention

The invention relates to a method and a system for ascertaining at least one traffic-related local information item for a vehicle.

2. Description of the Related Art

Methods and systems for ascertaining at least one traffic-related local information item for a vehicle are known within the context of driver assistance systems as distance warning systems or ACC: "Adaptive Cruise Control", for example. Such systems are usually based on a radar sensor transmission/reception unit in or on the vehicle.

SUMMARY OF THE INVENTION

It is an object of the invention to provide a method and a system for ascertaining at least one traffic-related local information item for a vehicle which are inexpensive and simple. In this context, the local information item is advantageously ascertained from easily obtainable data.

The term 'local information item' as used herein means an information item that relates to the surrounding area or vicinity of the vehicle for which the item is ascertained.

The method according to the invention is distinguished in that a reception device in a radio system in one vehicle for vehicle-internal capture and evaluation of data for at least one operating variable from the one vehicle is used to receive data transmitted from a radio system in at least one other vehicle in the vicinity of the one vehicle as defined by the reception range of the reception device, wherein the traffic-related local information item is ascertained from the data from that at least one other vehicle.

The vehicle is preferably a motor vehicle, particularly an automobile.

In accordance with one preferred embodiment of the invention, the radio system in the one vehicle and/or in the other vehicle is a wireless tire pressure monitoring system (TPMS). Tire pressure monitoring systems are used for monitoring the tire pressure in vehicles in order to minimize accidents which are caused by excessively low tire air pressure and to recognize such accidents at an early stage. A distinction is drawn between direct and indirect tire pressure monitoring systems. In particular, the radio systems in both vehicles are wireless tire pressure monitoring systems.

Normally, only the vehicle's own TPMS signals are received by the radio system of the vehicle. The radio system monitors IDs of the signals and signals with IDs which have not been taught to the vehicle are filtered out. However, it is no problem technically to deactivate the ID filtering and also to receive signals with the IDs of other vehicles. In addition, it is also necessary to support different protocols, since the TPMS transmitters come from different manufacturers; in this area, however, there are also efforts to standardize this: a generic auto industry protocol for TPMS.

Typically, the transmission modules of a TPMS send their data relatively rarely (usually approximately once per minute, although the repetition rate may under certain circumstances also be up to four times per minute). If this information is also received from vehicles other than the sending vehicle (that is to say in this case from the one vehicle) then the signal can be distinguished from the signals or data from the vehicle's own radio system using the signal ID. These external data can then be used in effect as a CAM (Common Awareness Message).

In a particular embodiment, the radio system in the one vehicle is a radio system for receiving data from a wireless tire pressure monitoring system and/or from a radio key. By way of example, the radio key is part of an access and drive authorization system.

In accordance with a further preferred embodiment of the invention, the one vehicle has at least one further radio system which it uses to forward the data and/or the traffic-related local information item. This further radio system is preferably a radio system which is present in the vehicle, or these further radio systems are radio systems which are present in the vehicle. This at least one further radio system or wireless system may be an RKE, GSM, GPRS, EDGE, UMTS, LTE, WiMax, WLAN, ZigBee and/or Bluetooth system, for example. In this way, the data and/or the traffic-related local information item can be forwarded to or interchanged with further vehicles and/or base stations or relay stations. Such "networking" allows the density of information to be greatly increased.

In particular, the further radio system is an access and drive authorization system, preferably what is known as a remote keyless entry system (RKE) and/or a passive entry system (PASE).

In vehicles today, these radio systems, namely a remote keyless entry (RKE) or passive entry (PASE) radio system, typically at 433 MHz and 868 MHz (USA 315 MHz and 915 MHZ), respectively, and an active TPMS (Tire Pressure Monitoring System), typically at 433 MHz (USA 315 MHz), are largely already in place. Ideally, these two systems are combined such that installed hardware can be used for both functions. This can be done, by way of example, by virtue of only one antenna being used, and the reception device (the receiver) receiving and being able to distinguish both signals. Sometimes, this requires the reception device to be able to support both 433 MHz and 868 MHz and possibly to switch between these two frequencies or to receive both frequencies simultaneously.

In remote keyless entry (RKE) and passive entry (PASE) radio systems, the data sent by the "key" are data sent on an event basis; in the case of active tire pressure monitoring systems (TPMS), the data sent are typically periodically sent data or are triggered by the vehicle.

If the method is, in particular, an addition to a system for wireless drive authorization, i.e., remote keyless entry (RKE), expanded to produce vehicle-to-X (C2X) communication, it is not necessary to make any change to the TPMS and/or RKE system and/or PASE system. The private domain of the vehicle keeper or vehicle driver remains protected, since no new data are sent, the data are sent only very rarely and the data do not contain any information about an association with an individual vehicle.

In accordance with yet a further preferred embodiment of the invention, the traffic-related local information item also includes at least one movement information item for the vehicle movement of the one vehicle. By way of example, a possible movement information item is the speed of the one vehicle.

Alternatively or in addition, the traffic-related local information item also includes at least one location information item for the one vehicle. The location information item is preferably a location information item that is ascertained using the global positioning system (GPS). Alternatively or in addition, the traffic-related local information item also includes the signal level for the data (or signals).

In particular, the traffic-related local information item can be a vehicle density information item and/or a distance information item relating to the other vehicle and/or a relative movement information item for the one and the other vehicle or the other vehicles.

Furthermore, the number of the other vehicles in the vicinity can be estimated and in this way queue recognition performed or supported, for example. In addition, it is possible to recognize whether or not the received signal IDs change very often. In combination with the vehicle's own speed, it is then likewise possible to improve the queue recognition, for example if the speed is very low or too low for the class of road, or traffic in adjacent lanes is inferred.

It is also possible to use the reception field strength of the relevant reception device to infer the distance and hence to create a better picture of the vicinity of the one vehicle. Although this distance is imprecise, it is possible for an estimate to be made and particularly for a comparison between different received messages to be made. In this context, a typical transmission power of −10 dBm to −20 dBM (0.1 to 0.01 mW) can be regarded as a reference. A typical reception power for TPMS is −80 dBm to −60 dBm. This prescribes the reception range.

The information system according to the invention for ascertaining at least one traffic-related local information item for a vehicle is distinguished in that the system has an associated reception device in a radio system for the vehicle-internal capture and evaluation of data for at least one operating variable from the one vehicle, which reception device can be used in order to receive sent data from a radio system in at least one other vehicle in the local of the one vehicle as defined by the reception range of the reception device, and in that it has an evaluation device for ascertaining the traffic-related local information item from the data. In this case, the vehicle is preferably a motor vehicle, particularly an automobile.

In accordance with one preferred embodiment of the invention, the radio system is a wireless tire pressure monitoring system (TPMS). In this case, the operating variable for the vehicle is the tire pressure of the tires on the vehicle.

In accordance with a further preferred embodiment of the invention, the information system has at least one further radio system, which the information system uses to forward the data and/or the traffic-related local information item.

By way of example, said further radio system is an RKE, GSM, GPRS, EDGE, UMTS, LTE, WiMax, WLAN, ZigBee and/or Bluetooth system. In this way, the data and/or the traffic-related local information item can be forwarded to or interchanged with further vehicles and/or base stations or relay stations. Such "networking" allows the density of information to be greatly increased. In particular, the further radio system is an access and drive authorization system, particularly what is known as a remote keyless entry system (RKE) and/or a passive entry system (PASE).

In accordance with a preferred refinement of the invention, the traffic-related local information item also includes at least one movement information item for the vehicle movement of the one vehicle. Alternatively or in addition, the traffic-related local information item also includes at least one location information item for the one vehicle. The location information item is preferably a location information item that is ascertained by means of GPS. Alternatively or in addition, provision is also preferably made for the ascertainment of the traffic-related local information item includes the signal level for the data. In this regard, provision is made for the information system to have appropriate devices or to cooperate with the devices.

The reception field strength in the information system can also be used to infer the distance and hence to create a better picture of the local. Although this distance is imprecise, an estimate can be made and particularly a comparison between different received messages can be made. In this case, a typical transmission power of −10 dBM to −20 dBM (0.1 to 0.01 mW) can be regarded as a reference. A typical reception power for TPMS is −80 dBm to −60 dBm.

Advantageously, the traffic-related local information item is a vehicle density information item and/or a distance information item relating to the other vehicle and/or a relative movement information item for the one and the other vehicle.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

The invention is explained in more detail below using a preferred exemplary embodiment with reference to the appended drawing, in which The FIGURE is a plan view of two vehicles with radio systems for the vehicle-internal capture and evaluation of operating variable data and an information system in accordance with one embodiment of the invention.

DETAILED DESCRIPTION OF THE PRESENTLY PREFERRED EMBODIMENTS

The FIGURE shows a plan view of two vehicles 10, 12, in the form of motor vehicles, with a respective radio system 14, 16 for the vehicle-internal capture and evaluation of data for at least one operating variable from the respective vehicle 10, 12. The two radio systems 14, 16 are in the form of tire pressure monitoring systems (TPMS). The one vehicle 10 has the first radio system 14 and the other vehicle 12 has the (other) second radio system 16.

Each of the two radio systems 14, 16 is made up of four sensor modules 22, 24, arranged in the respective tires 18.1, 18.2. 18.3, 18.4 of the one vehicle 10 and in the tires 20.1, 20.2, 20.3, 20.4 of the other vehicle 12. Each sensor module includes or is associated with a transmission device which transmits vehicle internal data to a respective reception device 26, 28 for the vehicle-internal capture and evaluation of the vehicle-internal data. The first radio system 14 in the one vehicle 10 is thus made up of four sensor modules 22 and the reception device 26, and the second radio system 16 in the other vehicle 12 is made up of the four sensor modules 24 and the reception device 28. The respective reception range 30, 32 of the reception devices 26, 28 bounds the vicinity or surrounding area for the respective vehicle 10, 12.

Each of the vehicles 10, 12 also has an information system 34, 36 for ascertaining the at least one traffic-related local information item for the respective vehicle 10, 12, with which system the respective reception device 26, 28 in the vehicle 10, 12 is associated. The system 34, 36 has a respective evaluation device for ascertaining the traffic-related local information item from the received data.

As the FIGURE shows, the reception device 26, 28 and the information system 34, 36 preferably form a unit. A further radio system 38 is used by the one vehicle 10 to send the traffic-related local information item(s) to other vehicles and/or a base station within range of its further radio system. In this case, the further radio system 38 has a greater range than the one radio system, that is to say in this example the wireless tire pressure monitoring system.

The following operation arises: for the purpose of ascertaining the at least one traffic-related local information item for the one vehicle 10, the reception device 26 in the radio system 14 (wireless tire pressure monitoring system) is used in order to receive the sent data from the second radio system 16 in the other vehicle 12 in the local of the one vehicle 10 as defined by the reception range 30 of the reception device 26, wherein the traffic-related local information item is ascertained from the data by the evaluation device in the information system 34. In this simple example, the information system is in the form of an apparatus 34 within the vehicle.

The traffic-related local information item includes not only an evaluation of the data but also, by way of example, a movement information item for the vehicle movement of the one vehicle, namely the vehicle speed.

The one vehicle 10 sends this local information item using the further radio system 38, for example a WLAN system (WLAN: Wireless Local Area Network, e.g. IEEE 802.11a/b/g/n/p) to other vehicles and uses the further radio system 38 to also receive the local information from other vehicles, so that an "information cluster" is obtained.

The same can naturally also apply to the other vehicle 12 using further radio system 40.

The operation will now be explained in four practical examples:

$1^{st}$ Example—Queue Recognition

The one vehicle 10 uses its information system or its apparatus 34 (e.g., RKE module) to receive very many different TPMS data very often, all at once. In addition, the speed v of the driver's own vehicle 10 has become very low (and a distance sensor which may be present, such as a radar, has been used to recognize a very short distance from the vehicle in front). From this, the system infers that there is a queue and it is able to send this information by communication technology (e.g. RKE or GSM or GPRS or EDGE or UMTS or LTE or WiMax or WLAN or ZigBee or Bluetooth) in order to inform other vehicles 12.

$2^{nd}$ Example

The one vehicle 10 is traveling at approximately constant speed v. During this time, it recurrently receives TPMS data with the same ID and approximately the same field strength from the other vehicle 12. From this it can be inferred that there is heavy traffic, and other vehicles 12 are traveling at approximately the same speed v.

$3^{rd}$ Example

The one vehicle 10 is traveling at approximately constant speed v. During this time, it recurrently receives TPMS data with the same ID and approximately the same field strength. In addition, it receives the TPMS data always in four pairs or can always identify four messages (from the four tires) as being associated with another vehicle 12. From the field strengths of said TPMS data or messages, it is now possible to infer the approximate position of the other vehicle 12, that is say whether it is in front of the driver's own vehicle 10 or next to it.

$4^{th}$ Example—Lane Change Assistant

The one vehicle 10 is traveling on a multilane road and receives TPMS data from other vehicles 12 which are traveling directly next to it. From the field strength of the signals, it is now possible to infer the approximate position of the adjacent other vehicles 12 (adjacent vehicles). If the one vehicle 10 now wishes to change lane, the driver of said one vehicle 10 can be warned about an impending collision.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A method for ascertaining at least one traffic-related local information item for a first vehicle, comprising:

deactivating ID filtering in the first vehicle to receive signals with the IDs of other vehicles;

using a reception device of a first wireless tire pressure monitoring system of the first vehicle to receive data including the at least one traffic-related local information item that is transmitted from a tire pressure monitoring sensor transmitter in a second wireless tire pressure monitoring system in at least a second vehicle in a vicinity of the first vehicle defined by a reception range of the reception device, wherein the reception device in the first wireless tire pressure monitoring system is configured for vehicle-internal capture and evaluation of data from a plurality of sensor modules;

receiving by the reception device of the first tire pressure monitoring system tire pressure monitoring system data directly from tire pressure monitoring system sensors in the second vehicle;

determining from the received system tire pressure monitoring system data from tire pressure monitoring system sensors in the second vehicle a relative location of the second vehicle with respect to the first vehicle; and ascertaining the at least one traffic-related local information item from the data received from the second radio system, wherein the at least one traffic-related local information item is a vehicle density information item.

2. The method as claimed in claim 1, further comprising forwarding at least one of the data and the traffic-related local information item using at least one further radio system of the first vehicle.

3. The method as claimed in claim 1, wherein the ascertaining of the traffic-related local information item also includes ascertaining at least one movement information item for the vehicle movement of the first vehicle.

4. The method as claimed in claim 1, wherein the traffic-related local information item further comprises at least one of a distance information item relating to the second vehicle and a relative movement information item for the first and second vehicles.

5. An information system for ascertaining at least one traffic-related local information item for a first vehicle, comprising:

a reception device in a first wireless tire pressure monitoring system configured for vehicle-internal capture and evaluation of data for at least one operating variable from the first vehicle, said reception device further configured to receive data transmitted directly from a plurality of tire pressure sensor transmitters in a second wireless tire pressure monitoring system in at least one second vehicle in the vicinity of the first vehicle as defined by the reception range of the reception device;

determining from the received system tire pressure monitoring system data from tire pressure monitoring system sensor transmitters in the second vehicle a relative location of the second vehicle with respect to the first vehicle; and an evaluation device for ascertaining the traffic-related local information item from said received data from the second radio system, wherein the traffic-related local information item is a vehicle density information item, and wherein ID filtering in the first vehicle is deactivated to receive signals with the IDs of other vehicles.

6. The system as claimed in claim 5, further comprising at least one further radio system in the first vehicle configured to forward at least one of the data and the traffic-related local information item.

7. The system as claimed in claim 5, wherein the evaluation device also ascertains at least one movement information item for the vehicle movement of the first vehicle.

8. The system as claimed in claim 5, wherein the traffic-related local information item further comprises at least one of a distance information item relating to the second vehicle and a relative movement information item for the first and second vehicles.

9. The method as claimed in claim 2, wherein the at least one further radio system of the first vehicle is an access system.

10. The system as claimed in claim 6, wherein the at least one further radio system of the first vehicle is an access system.

* * * * *